US005694755A

United States Patent [19]

Frøystad

[11] Patent Number: 5,694,755

[45] Date of Patent: Dec. 9, 1997

[54] BUOYANT LINE AND METHOD FOR FORMING

[75] Inventor: Per Frøystad, Bølandet, Norway

[73] Assignee: Froystad Fiskevegn AS, Norway

[21] Appl. No.: 787,715

[22] Filed: Jan. 23, 1997

Related U.S. Application Data

[63] Continuation of Ser. No. 380,164, Jan. 30, 1995, abandoned.

[30] Foreign Application Priority Data

Feb. 2, 1994 [NO] Norway ..... 940343

[51] Int. Cl.[6] ..... D02G 3/06; D02G 3/08

[52] U.S. Cl. ..... 57/211; 57/210; 57/224; 57/236

[58] Field of Search ..... 57/210, 236, 231, 57/3, 13, 224, 30, 211; 43/44.98

[56] References Cited

U.S. PATENT DOCUMENTS

| | | | |
|---|---|---|---|
| 411,161 | 9/1889 | Maynard | 43/44.98 |
| 1,602,312 | 10/1926 | Qurin | 43/44.98 |
| 3,558,420 | 1/1971 | Opfell | 161/176 |
| 3,849,929 | 11/1974 | Martuch | 43/44.98 |
| 3,936,335 | 2/1976 | Martuch | 156/79 |
| 3,968,725 | 7/1976 | Holzhauer | 87/6 |
| 5,131,218 | 7/1992 | Berger | 57/211 |

FOREIGN PATENT DOCUMENTS

| | | |
|---|---|---|
| 153 975 B | 2/1982 | Denmark . |
| 81624 | 2/1894 | Germany . |
| 167739 | 7/1904 | Germany . |
| 249017 | 1/1911 | Germany . |
| 78776 | 7/1951 | Norway . |
| 5188 | 12/1932 | United Kingdom . |
| 1 364 895 | 8/1974 | United Kingdom . |
| 2 239878 | 7/1991 | United Kingdom . |

*Primary Examiner*—William Stryjewski
*Attorney, Agent, or Firm*—Skjerven, Morrill, MacPherson, Franklin & Friel; Thomas S. MacDonald

[57] ABSTRACT

A buoyant line or rope made from two or more strands of natural or synthetic fibers, with the fibers in one or more of the strands being arranged (e.g., by being spun or "laid") around a buoyant core. The relative buoyancy of the line may be increased or decreased by changing the number of strands having a buoyant core or by changing the diameter of the buoyant cores.

9 Claims, 1 Drawing Sheet

BUOYANT LINE AND METHOD FOR FORMING

This application is a continuation of application Ser. No. 08/380,164, filed Jan. 30, 1995, now abandoned.

FIELD OF THE INVENTION

This invention relates to a buoyant line or rope made from natural or synthetic fibers and having a buoyant core.

BACKGROUND OF THE INVENTION

A buoyant line or rope is commonly used in fishing tackle such as fishing lines and nets or in other applications where it is desirable for the line or rope to be buoyant or to float on the surface of the water.

Previously, floating lines have been produced by plaiting the strands of the line around a continuous buoyant core of expanded plastic material. With this type of floating line, only a single buoyant core is used and the strands are plaited to form a "jacket" around the core. Such plaited floating lines are expensive to produce as the mechanical production method is complicated and slow. Further, it is difficult and time-consuming to splice the plaited lines because each strand in the end of each line must be interwoven into the end of the other line.

In U.S. Pat. No. 3,558,420, a melted, synthetic polymer material is extruded through rotating nozzles to form hollow fibers which are interwoven with solid fibers of the same or different diameter to form marine lines, ropes or nets. Unfortunately, such a line or rope is difficult and expensive to manufacture, and has a relatively low buoyancy.

SUMMARY OF THE INVENTION

In accordance with the present invention, a buoyant line or rope is made from two or more strands which in turn are formed from natural or synthetic fibers. In at least one of the strands, the fibers are arranged around a buoyant core. This improved buoyant line is cheaper to manufacture, has improved buoyancy, and can be spliced more easily and quickly than existing floating lines or ropes. In one embodiment of this invention, the individual strands are formed from fibers which are spun ("laid") around a buoyant core such as expanded polypropylene, polythene, polyester, nylon, or polystyrene. In another embodiment, the buoyant core is a hollow core made from a material such as extruded polypropylene, polythene, polyester, nylon, or polystyrene.

Since a plaited line requires approximately 10–15 times as long to manufacture as a "laid" line, the spun or "laid" buoyant line of the present invention has significantly lower production costs. It is also much faster and easier to splice the "laid" line of the present invention, because arranging the buoyant portions of the line as the cores of the individual strands allows the line to be spliced in the ordinary manner used for laid lines.

DETAILED DESCRIPTION

Figure 1:
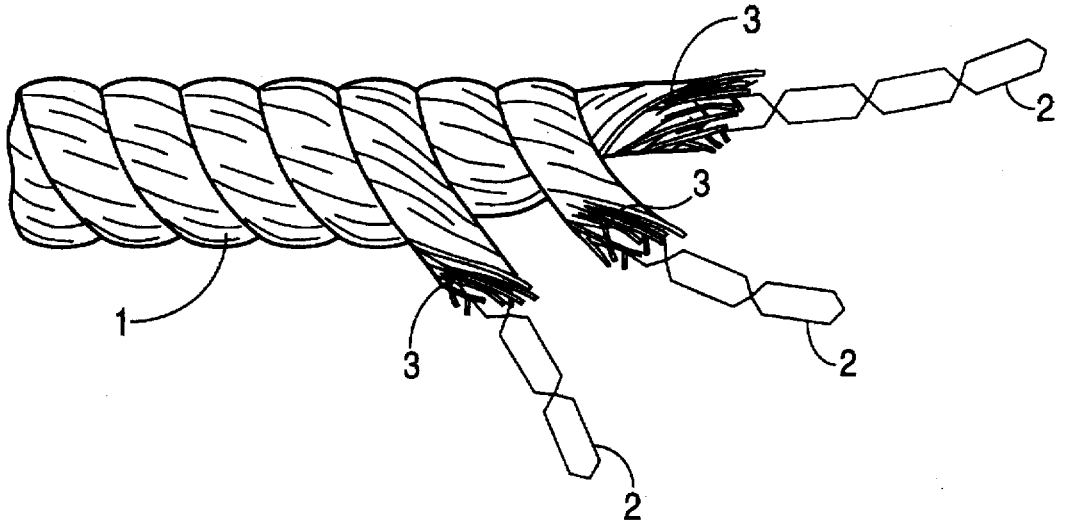
FIG. 1 illustrates a buoyant line according to one embodiment of the present invention, with the strands in one end of the line separated and the fibers removed to show the buoyant core of each strand.
Figure 2:
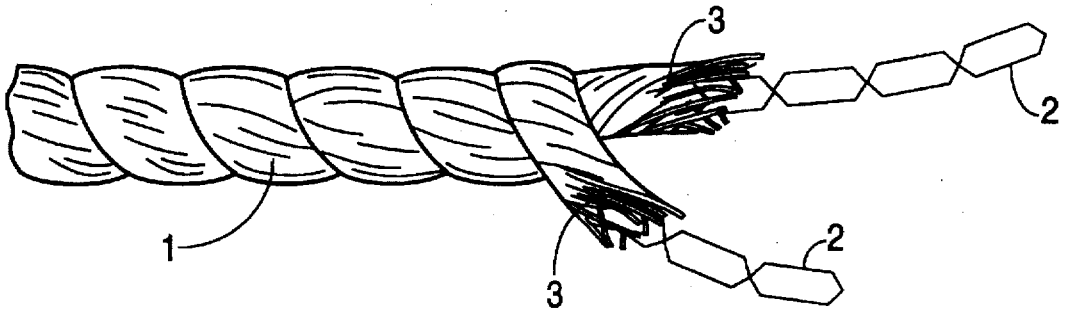
FIG. 2 illustrates another embodiment of a buoyant line.

FIG. 1 illustrates one embodiment of a buoyant line 1 having three strands 3 according to the present invention. In this embodiment, each individual strand 3 is formed from natural or synthetic fibers (not shown in detail) such as hemp, Manilla hemp, nylon, or terylene, arranged (e.g., by being spun or "laid") around a buoyant core 2. The buoyant core 2 in the center of each strand 3 is protected from damage by the surrounding fibers. The individual strands 3 are then intertwined (e.g., by also being spun or "laid") to form the buoyant line 1.

In the embodiment of FIG. 1, each of the individual strands 3 has a buoyant core 2. It should be recognized, however, that the buoyancy of the line 1 may be reduced if desired by using one or more strands 3 which do not have a buoyant core 2. Also, the buoyancy of the line 1 may be reduced (or increased) by reducing (or increasing) the diameter of the cylindrical buoyant cores 2.

FIG. 1 shows each buoyant core 2 as being formed from a plurality of separate but preferably continuous buoyant elements. For example, the separate buoyant elements may be connected in such a manner as to resemble a "string" of sausages. An advantage of this structure is that the line or rope remains buoyant even if one or several of the individual buoyant elements are punctured or otherwise leak. In other embodiments one or more of the buoyant cores 2 is formed from a single continuous buoyant element. Further, in some embodiments the buoyant cores 2 only provide buoyancy, while in other embodiments one or more of the buoyant cores 2 is also a load-bearing element.

It is to be understood that the above description is intended to be illustrative and not restrictive. Many variations of the invention will become apparent to those of skill in the art upon review of this disclosure. Merely by way of example, the embodiment of FIG. 1 illustrates a buoyant line formed from three strands, but it will be apparent to those of skill in the art that a buoyant line may be formed from only two or from more than three strands without departing from the scope of the invention herein. The scope of the invention should, therefore, be determined not with reference to the above description, but instead should be determined with reference to the appended claims along with their full scope of equivalents.

I claim:

1. A buoyant line, comprising:

a first strand comprising a first plurality of fibers; and a second strand comprising a second plurality of fibers arranged around a buoyant core, said buoyant core consisting essentially of an expanded plastic material or an extruded plastic material having a hollow core; and wherein the first and second strands are intertwined.

2. A line as in claim 1 wherein the second plurality of fibers in the second strand are spun fibers arranged around the buoyant core.

3. A line as in claim 1 wherein the fibers in said second strand are spun fibers arranged around the buoyant core.

4. A line as in claim 1 wherein the buoyant core expanded plastic material is selected from the group consisting of expanded polypropylene, polythene, polyester, nylon, and polystyrene.

5. A line as in claim 1 wherein the buoyant core extruded plastic material is selected from the group consisting of extruded polypropylene, polythene, polyester, nylon and polystyrene.

6. A line as in claim 1 wherein the buoyant core comprises a plurality of buoyant elements in a sausages-like string.

7. A line as in claim 1 wherein the first and second plurality of fibers are selected from the group consisting of hemp, Manila hemp, nylon, and terylene.

8. A buoyant line, comprising at least two strands, each comprising a plurality of fibers, where at least one of the strands is provided with a buoyant core, said buoyant core consisting essentially of an expanded plastic material or an extruded plastic material having a hollow core.

9. A line as in claim 8 wherein the buoyant core comprises a string of connected cylindrical buoyant cores and wherein the buoyancy of the line is determined by the diameter of the buoyant cores.

* * * * *